United States Patent [19]

Amitani et al.

[11] 4,314,756

[45] Feb. 9, 1982

[54] CLEANING DEVICE

[75] Inventors: Joji Amitani, Yokohama; Takashi Ito, Kawasaki; Kazuhiro Hirayama, Yokohama, all of Japan

[73] Assignee: Canon Kabushiki Kaisha, Tokyo, Japan

[21] Appl. No.: 70,983

[22] Filed: Aug. 30, 1979

[30] Foreign Application Priority Data

Sep. 1, 1978 [JP] Japan ..... 53-107881

[51] Int. Cl.[3] ..... G03G 21/00

[52] U.S. Cl. ..... 355/15; 15/256.51; 118/652

[58] Field of Search ..... 355/15; 118/652; 15/256.5, 256.51, 306 A, 308, 418–420, 301

[56] References Cited

U.S. PATENT DOCUMENTS

Re. 29,632 5/1978 Tanaka et al. ..... 355/15 X
3,838,472 10/1974 Oriel ..... 355/15 X
3,917,397 11/1975 Tanaka et al. ..... 355/15
3,969,785 7/1976 Ogawa et al. ..... 15/256.51 X

OTHER PUBLICATIONS

IBM Tech. Disc. Bull., vol. 12, No. 11, Apr. '70, p. 1819.

*Primary Examiner*—Richard L. Moses
*Attorney, Agent, or Firm*—Fitzpatrick, Cella, Harper & Scinto

[57] ABSTRACT

This invention provides a cleaning device for an image bearing member which is able to effect a good cleaning without scattering removed developer. The device includes an elastic cleaning blade contacting the image bearing member, hood means covering the vicinity of the portion where the blade contacts the surface of the image bearing member, suction means and guiding means for guiding an air flow to strike against said blade contacting portion.

14 Claims, 6 Drawing Figures

CLEANING DEVICE

BACKGROUND OF THE INVENTION

1. Field of the Invention

This invention relates to a cleaning device for removing developer remaining on an image bearing member, and more particularly to a cleaning device which can carry out good cleaning without scattering the removed developer.

2. Description of the Prior Art

Heretofore, in an image formation apparatus based on electrophotography, the surface of an image bearing member has been cleaned for repetitive utilization. In such an image formation apparatus, for example, a photosensitive medium having a photoconductive layer is used as the image bearing member, and an electrostatic latent image is formed on the photosensitive medium by charging means, exposure means, etc., whereafter the electrostatic image is developed into a visible image by developing means. The visible image is transferred to a transfer medium, whereafter the transfer medium is separated from the surface of the photosensitive medium and the image thereon is fixed by fixing means, thus completing the image formation. On the other hand, the surface of the photosensitive medium after the image transfer is cleaned by a cleaning device to remove developer remaining on the surface of the photosensitive medium, thus becoming ready for reuse.

Various cleaning devices usable with such image formation apparatus have been proposed such as those based on the fur brush cleaning system, the web cleaning system and the elastic blade cleaning system. Particularly, the cleaning device based on the elastic blade cleaning system has been widely used for its simple construction, its high cleaning efficiency and its excellent durability. As compared with the fur brush and the web cleaning system, the elastic blade cleaning system suffers less from the possibility of foreign materials being admixed with the removed developer and this leads to the reusability of the developer which is a feature of the elastic blade cleaning system.

In such elastic blade cleaning system, the removed developer has a remarkable tendency to accumulate in the vicinity of the end of the elastic blade which bears against the surface of the image bearing member, and particularly in the vicinity of the top of the drum-shaped image bearing member. In order to remove such accumulated developer, it has been the common practice to provide conveyor means for the accumulated developer. Also, in the side portion or the lower portion of the drum-shaped image bearing member, a construction has been chosen in which the developer may drop by gravity. However, again in such arrangement, if the image bearing member is moved at a high speed, the tendency of the developer to accumulate on the portion of the elastic blade which bears against the surface of the image bearing member has been unavoidable.

Such accumulated developer might sometimes be fused to the surface of the image bearing member due to the friction between said developer and said surface while, on the other hand, the developer itself might be over-charged or melted to suffer from changes in its property.

Such a phenomenon as the fusion of the developer to the surface of the image bearing member or the changes in property of the developer has also occurred in the case of the fur brush cleaning system even when the image bearing member is being moved at a low speed and as compared with this, the possibility of occurrence of such phenomenon is low in the case of the elastic blade cleaning system even when the image bearing member is being moved at a high speed, but it is apparent that this is not preferable in high-speed image reproduction.

The present invention has been made in view of the above-noted situation.

SUMMARY OF THE INVENTION

It is an object of the present invention to provide a cleaning device which can effect highly efficient cleaning without causing fusion and changes in property of the accumulated developer.

The device of the present invention has an elastic cleaning blade which bears against the surface of an image bearing member, and suction means for forming a suction air stream in the vicinity of that portion of the elastic cleaning blade which bears against the surface of the image bearing member, said suction means having a suction opening end disposed adjacent to the surface of the image bearing member.

Further, the device of the present invention has an edge member at the suction opening end of said suction means for varying the distance between it and the surface of the image bearing member. This edge member may be brought into intimate contact with the surface of the image bearing member during the stoppage of the suction to thereby present outflow of the removed developer.

The invention will become fully apparent from the following detailed description thereof taken in conjunction with the accompanying drawings.

DESCRIPTION OF THE PREFERRED EMBODIMENTS

Figure 1:
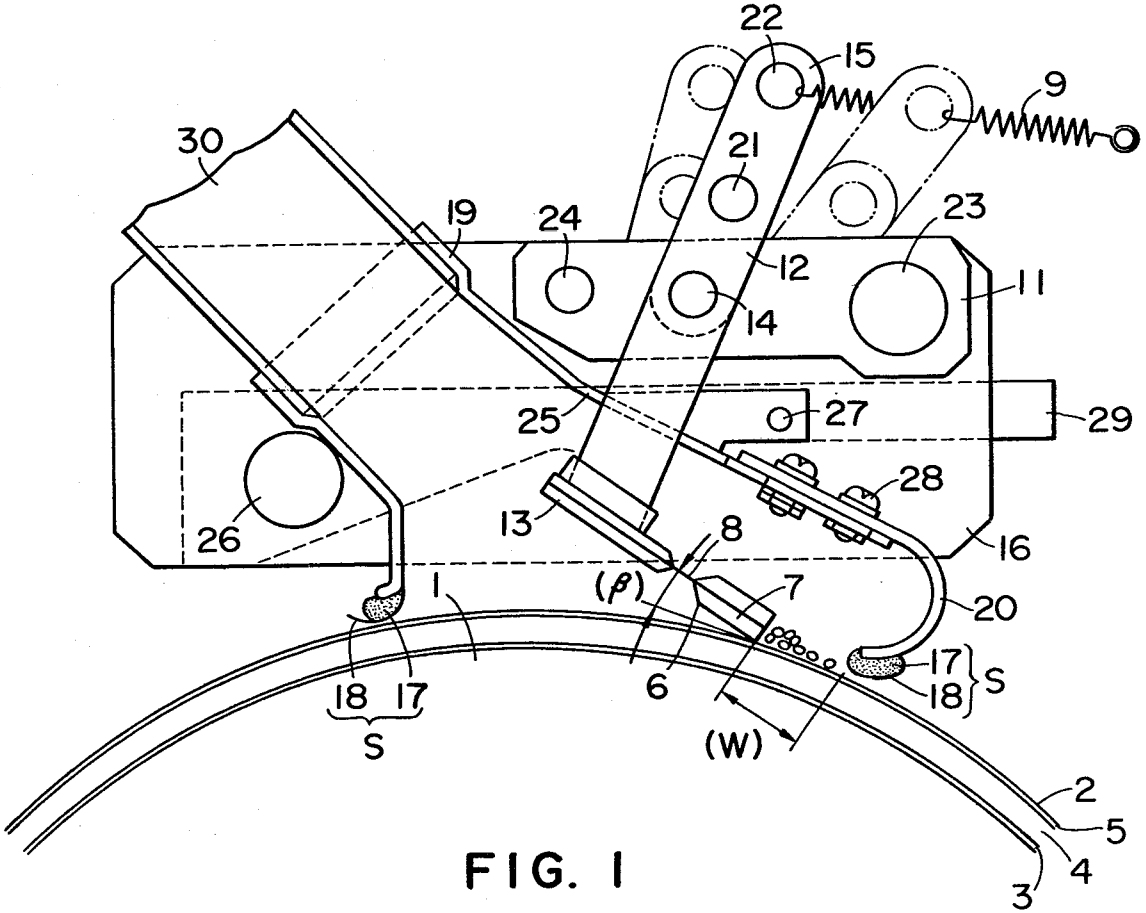
FIG. 1 is a side cross-sectional view of a specific embodiment of the cleaning device according to the present invention.
Figure 2:
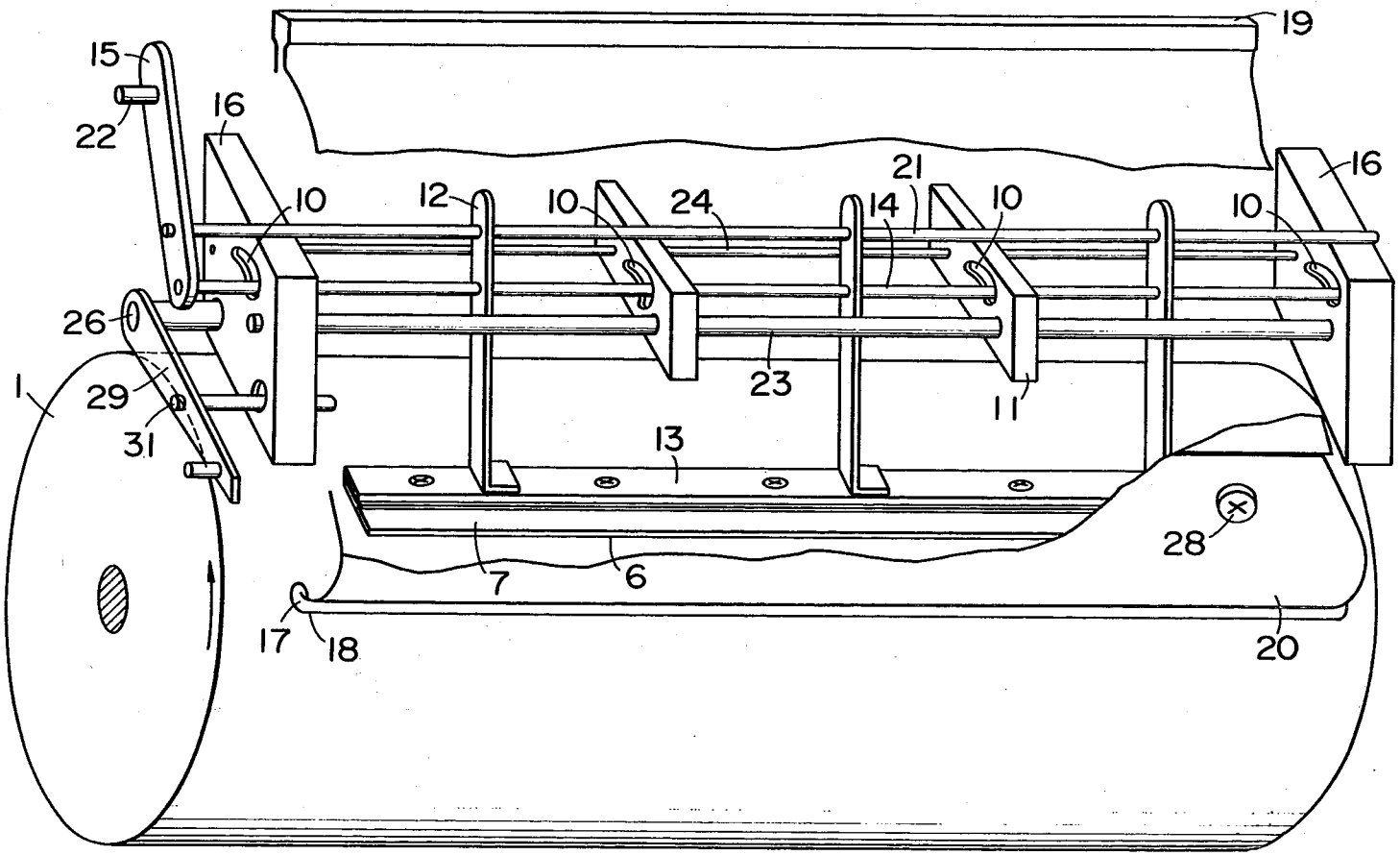
FIG. 2 is a perspective view of the FIG. 1 device.

FIG. 1 is a side cross-sectional view of a specific embodiment of the cleaning device according to the present invention, and FIG. 2 is a perspective view of the same device.

Designated by 1 is a drum-shaped image bearing member rotatable in the direction of arrow.

A Carlson photosensitive medium having a photoconductive layer of Se, CdS or like material exposed or an NP photosensitive medium basically comprising a conductive substrate 3, a photoconductive layer 4 and an insulating layer 5 as shown is suitably utilized as the surface 2 of the drum-shaped image bearing member.

An elastic cleaning blade is so disposed as to bear against the surface 2 of the drum-shaped image bearing member. The shown elastic cleaning blade 6 basically comprises a tip 7 which contacts the surface of the image bearing member, and a support plate 8 having the tip 7 secured to one end thereof and flexible so as to cause the tip 7 to bear against the surface of the image bearing member with a moderate resilient force.

The opposite end of the support plate 8 is gripped by a blade gripping plate 13.

This blade gripping plate 13 is secured to one end of each of a plurality of blade setting arms 12 rotatably fitted on a shaft 14 extending between the two side plates of the cleaning device: On the other hand, the blade setting arms 12 are pivotable about the shaft 14 to set the angle at which the tip of the elastic cleaning blade bears against the surface of the image bearing member. That is, the shaft 14 is secured to one end of an operating lever 15 and further, a connecting shaft 21 connecting the intermediate portion of the operating lever 15 to the ends of the blade setting arms 12 so as to ensure positive operative association between the blade setting arms 12 and the lever 15 is provided substantially in parallel to the shaft 14. The end of the operating lever 15 is provided with a projection 22 and the blade setting arms 12 are pivoted about the shaft 14 by operation of the operating lever. A spring 9 is retained on the operating lever 15 to always impart a resilient force in the direction in which the blade bears against the surface of the image bearing member. A pair of shafts 23 and 24 are provided between the two side plates 16 with the opposite ends of the former secured to the side plates 16. A plurality of spacer members 11 for maintaining the spacing between the shafts 23 and 24 are installed on the intermediate portions of these shafts at desired intervals.

The shaft 14 extends through arcuate slots 10 formed in the side plates 16 and spacer members 11. The shaft 14 is retained at a suitable position in the arcuate slots by means of a stop, not shown. The shaft 14 is freely rotatable by a bushing (not shown) disposed on that portion thereof which extends through the slots. The force with which the elastic cleaning blade bears against the surface of the image bearing member may be adjusted by the slot-retained position of this shaft.

On the other hand, a suction hole hood 19 is disposed so as to surround the elastic cleaning blade. This hood has the opposite ends thereof secured to the side plates 16. A slot 25 is formed in the upper surface of the hood and the blade setting arms extend through this slot so as to be pivotable to the right and left as viewed in FIG. 1.

A suction hole hood end member 20 is attached to the front face of the hood, namely, adjacent to that portion of the elastic cleaning blade which effects the cleaning action. This hood end member has a curled front face and is secured to the upper surface of the hood by coupling members 28 such as screws or the like which are adjustable in mounted position. Thus, the distance W between the curled front end of the hood end member and the end of the elastic cleaning blade is adjustable.

Further, a seal member S for isolating the space within the hood from the outside during stoppage of the suction and for permitting inflow of the outside air during the suction is disposed at that end of the hood end member which faces the image bearing member. The seal member comprises a porous elastic member 17 such as polyurethane or foamed rubber forming a core and a low friction insulating sheet 18 such as a Mylar sheet covering the outer portion which contacts the image bearing member surface.

The porous elastic member 17 exerts its resilient force is a direction to urge the low friction insulating sheet 18 against the surface of the image bearing member, and the resilient force is sufficient to bring the low friction insulating sheet 18 into contact with the surface of the image bearing member during stoppage of the suction while, on the other hand, the resilient force during the suction is of such a degree which does not prevent the outside air from being sucked in from between the sheet 18 and the surface of the image bearing member.

Figure 3:
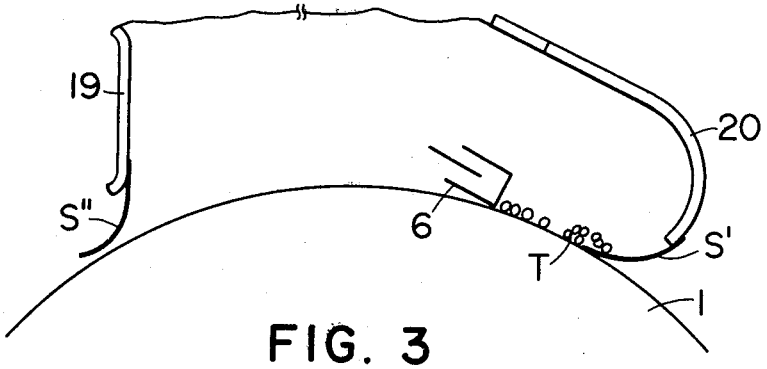
FIG. 3 illustrates the state of the cleaning device when the suction operation of the device has been stopped.

The seal member is not restricted to the above-described form but may also be formed of a low friction insulating thin film material S′ such as a Mylar film having a sufficient self-support strength as shown in FIG. 3, for example, and various modifications thereof may be made arbitrarily.

A seal member is provided at the end of the rear face of the hood which faces the image bearing member, so as to always maintain a sealed condition. A duct 30 leading to a suction fan is connected to the upper portion of the suction hole hood.

Figure 4:
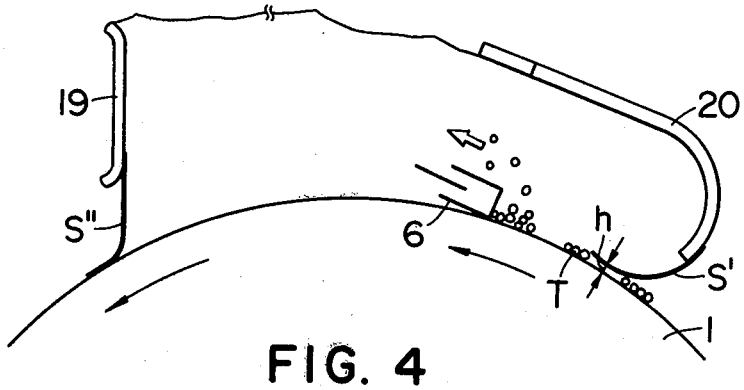
FIG. 4 illustrates the state of the cleaning device during the suction operation of the device.

FIG. 3 is a schematic view showing the state of the seal member S′ during stoppage of the suction, and FIG. 4 is a schematic view showing the state of the seal member during the suction.

As shown in FIG. 3, the sheet member S′ at the fore end of the hood is a Mylar film provided at the fore end thereof and is disposed so that the tip end thereof is curled into the space within the hood while, on the other hand, the sheet member S″ at the rear face of the hood comprises a similar Mylar film having the tip end thereof disposed outside the hood. During stoppage of the suction, both the sheet members contact the surface of the image bearing member to maintain the shape within the hood isolated from the outside.

Thus, even if there is removed developer suspended in the space within the hood during the suction, there is no fear that such developer leaks outwardly from within the hood. This leads to the elimination of the fear that the removed developer contaminates the neighborhood of the cleaning device.

FIG. 4 shows the state during the suction. In this case, the sheet member at the fore end of the hood has its tip end raised by the negative pressure in the space within the hood to permit inflow of the outside air. A clearance h is maintained between the tip end of the sheet member and the surface of the image bearing member.

On the other hand, the sheet member at the rear end of the hood has its tip end extending outwardly and the outwardly extending tip end of the sheet member is brought into intimate contact with the image bearing member by an increase of the negative pressure within the hood to further complete the sealing. Sheet members may also be provided on the sides of the hood and these may extend so as to contact the side edges of the drum to thereby maintain a sealing effect similar to that of the rear end of the hood.

Accordingly, the air stream in the space within the hood flows along the image bearing member through the fore end clearance h of the sheet member at the fore end of the hood and strikes against the fore end portion of the elastic blade so that the air stream changes its direction of flow upwardly and goes toward a suction port. Thus, the developer particles removed by the fore end of the elastic blade are carried with the air stream and taken away almost without accumulating at the portion where the blade bears against the surface of the image bearing member.

Thus, even when the image bearing member is being moved at a high speed, the developer removed by the elastic cleaning blade may be removed while being immediately carried with the suction air stream without accumulating on the portion where the blade bears against the surface of the image bearing member.

On the other hand, the side plates 16 to which the suction hood is secured are pivotally mounted with respect to a shaft 26, and a hood lever 29 has one end thereof engaged with the end of the shaft 26, and further a hood raising shaft 27 is fitted to the side plates so that the side plates can be raised by operation of the hood lever 29. Thus, the suction hood 19 secured to the side plates 16 may be raised.

By the raising operation of the operating hood lever 29, the elastic blade and the suction hood may be spaced apart from the surface of the image bearing member to prevent any impediment from occurring to the removal and mounting of the image bearing member.

In the device constructed as described above, when cleaning is effected, the developer removed from the surface of the image bearing member by that portion of the cleaning blade which bears against said surface is sucked by an air stream flowing in from the otuside, substantially without accumulating at said portion of the cleaning blade which bears against the surface of the image bearing member. In the cleaning, for example, in case where the developer removed by the portion of the cleaning blade which bears against the surface of the image bearing member is accumulated there, the pressure contact force was 1.5 kg according to the prior art, whereas according to the present invention, the cleaning has become possible by a pressure contact force of about 500 g.

Moreover, even if the image bearing member is moved at a high speed, the occurrence of an accident that the developer is fused to the surface of the image bearing member may be remarkably reduced.

Also, the decreased pressure contact force leads to remarkably reduced abrasion of the tip end of the elastic blade.

The device of the present invention is not restricted to the above-described specific construction, but of course, various modifications are possible.

For example, the hood is arranged so as to completely surround the elastic cleaning blade, whereas the elastic cleaning blade may be arranged so as to serve also as the rear hood.

The air stream so sucked in from the cleaning station is directed, for example, to a small cyclone, in which the developer contained in that air stream is separated and extracted. The air having the developer extracted therefrom may be discharged through a fiber filter, if required. On the other hand, the separated and extracted developer is returned to the developing device of the image formation apparatus for reuse.

Figure 5:
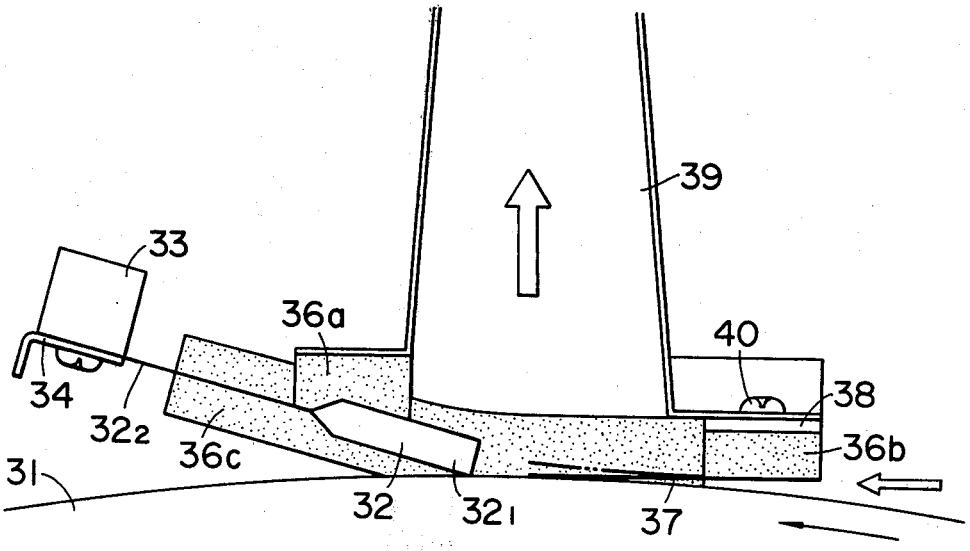
FIG. 5 is a side cross-sectional view of a modification of the cleaning device according to the present invention.
Figure 6:
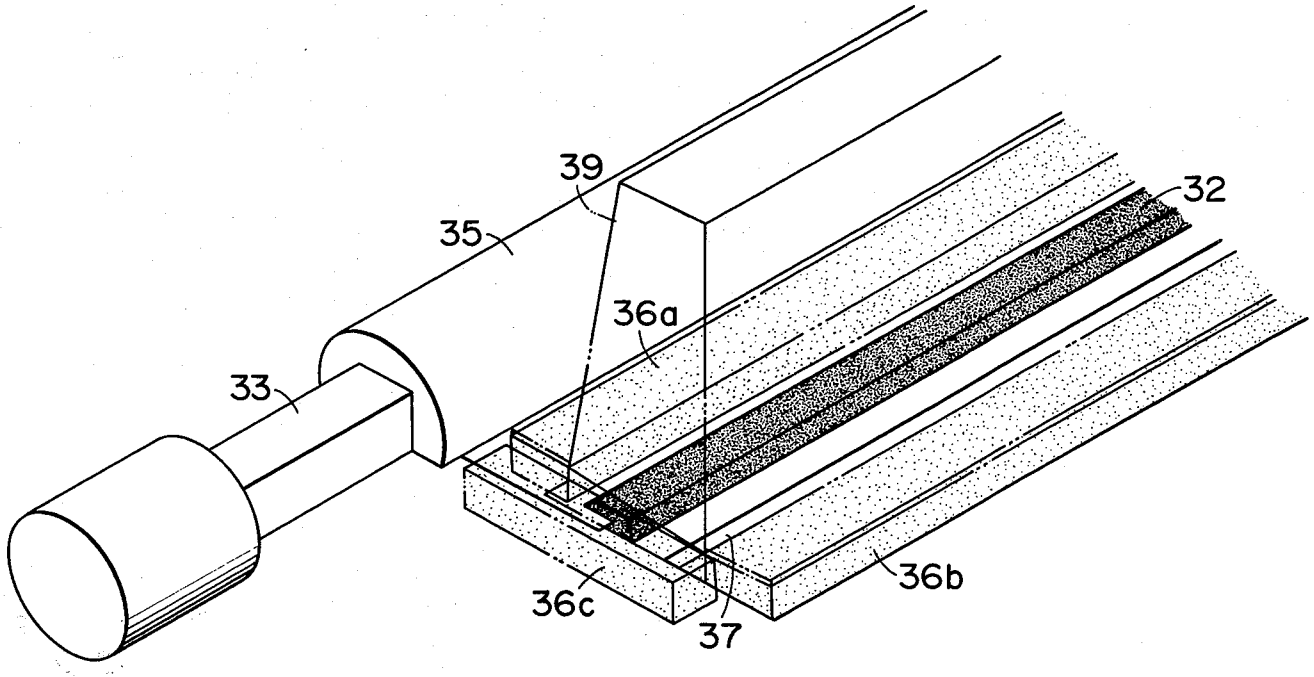
FIG. 6 is a perspective view of the FIG. 5 device.

FIG. 5 is a side cross-sectional view showing a modification of the cleaning device according to the present invention, and FIG. 6 is a perspective view thereof. Designated by 31 is a drum-shaped image bearing member similar to that shown in FIG. 1 and rotatable in the counter-clockwise direction of arrow. Denoted by 32 is an elastic cleaning blade which is similar to the described one in that an elastic member $\mathbf{32}_1$ is provided at the end of a support plate $\mathbf{32}_2$.

Designated by 33 is a support shaft for the blade which fixedly holds the support plate $\mathbf{32}_2$ between it and a keep plate 34, and which is removably mounted to a holder 35. There are further seen seal members 36*a*, 36*b* and 36*c*, a sheet member 37 and a fixing plate 38 to which the seal member 36*b* is attached. The fixing plate 38 is position-adjustably retained to the lower portion of a duct 39 by a screw 40.

In the above-described modification of the device, three sides of the image bearing member are surrounded by seal members and the remaining one side thereof is sealed by the elastic cleaning blade. Particularly, in the shown example, the sheet member 37 is attached to the underside of the seal member 36*b* and is movable with the seal member 36*b*. By adjusting the fixing plate 38 back and forth along the direction of movement of the image bearing member, the seal member 36*b* and the sheet member 37 are movable together. Thus, the distance between the sheet member 37 and the tip end of the elastic cleaning blade can be adjusted and so, it is easy to cause the air stream flowing in from under the sheet member 37 to effectively strike against the tip end portion of the blade.

The lateral seal member 36*c* is secured to the support plate $\mathbf{32}_2$ of the elastic cleaning blade 32 and this seal member 36*c* can also be urged against the surface of the image bearing member in accordance with the urging action of the elastic cleaning blade 32 to thereby enhance the sealing effect. Of course, this seal member 36*c*, like the seal member 36*b*, may be secured to the duct by means of a fixing plate.

An example will be shown below to make the present invention more easily understood.

EXAMPLE

A photosensitive medium formed by applying CdS binder resin onto an aluminum substrate and covering the same with a Mylar layer of 25 $\mu$ has been supported on a drum to provide a photosensitive medium drum. The drum diameter is 160 $\phi$, the width of the photosensitive medium is 420 mm, and the velocity of rotation of the drum is about 50 cm/sec. A primary charger, a secondary charger, a whole surface exposure light source, a developing device and a corona transfer device are disposed along the periphery of the drum to effect image formation, development and image transfer. The cleaning device according to the present invention is applied to the surface of the photosensitive medium after the image transfer.

The width of the tip blade has been 420 mm in accordance with the width of the photosensitive medium, and a pressure of 500 g has been applied to it. The gap from the end of the blade which bears against the photosensitive medium to the end of the suction port has been maintained at 5 mm. On the other hand, the suction port has been formed into the construction as shown in FIG. 1 by covering a moltplain material of 2 mm thickness with polyethylene terephthalate "Mylar" (tradename) of about 100 $\mu$. The clearance between the Mylar mounted portion and the photosensitive medium has been set to about 2 mm. Accordingly, during the non-suction, the end of the suction port is closed. On the other hand, during the cleaning operation, the removed developer is sucked from the portion of the elastic tip blade which bears against the photosensitive medium, without the developer accumulating there, by maintaining the amount sucked from the suction port at 1–1.5 $m^2$/min. Under such conditions, a test pattern has been continuously formed and after completion of the image transfer, 3–6 g/min. of developer has remained in the cleaning station but when the photo-sensitive medium has been cleaned by the elastic tip blade, the developer has immediately been washed away from the portion of the blade which bears against the photosensitive medium, by the suction air stream and little or no accumulation of the developer has been seen on the portion of the blade which bears against the photosenstive medium.

In the above-described Example, a good result could be obtained even by enlarging the gap between the portion of the elastic blade which bears against the photosensitive medium and the end of the suction port up to about 10 mm.

As described above in detail, the device of the present invention can effect highly efficient cleaning without accumulating the removed developer in the portion of the cleaning blade which bears against the photosensitive medium.

Also, by eliminating the accumulation of the developer in the portion of the cleaning blade which bears against the photosensitive medium and to which the pressure contact force is imparted, the fear may be eliminated that an accident such as fusion of the developer to the surface of the photosensitive medium resulting from a change in property of the accumulated developer may occur.

Further, in the device of the present invention, the end of the suction port is brought into intimate contact with the surface of the image bearing member during the nonsuction to enable the portion of the cleaning blade which bears against the image bearing member to be shielded from the outside, thus enabling the elimination of the fear that the ambience of the cleaning device is contaminated by scattered toner particles.

What we claim is:

1. A cleaning device for removing developer remaining on an image bearing member, which comprises an elastic cleaning blade contacting the image bearing member, hood means for covering the vicinity where the blade bears against the image bearing member, means for creating a suction within said hood means, and means for guiding air flow to strike against said blade bearing portion, said air flow guiding means having a sheet like member which is of a flexible material.

2. A cleaning device according to claim 1, in which the flexible sheet like member is disposed to bear against the surface of the image bearing member when said suction means is inoperative.

3. A cleaning device according to claim 2, in which the flexible sheet like member has a low friction property at least at its portion which bears against the image bearing member.

4. A cleaning device for removing developer remaining on an image bearing member, which comprises an elastic cleaning blade disposed against the moving direction of the image bearing member, a hood means to cover the vicinity where the blade bears against the image bearing member, a suction means connected with the hood means, and means for guiding air flow to strike the blade bearing portion which is disposed at the end portion of the hood means upstream of the image bearing member in said moving direction.

5. A cleaning device according to claim 4, in which said air flow guide means includes a sheet like member.

6. A cleaning device according to claim 5, in which the sheet like member is of a flexible material.

7. A cleaning device according to claim 6, in which the flexible sheet like member is disposed to bear against the surface of the image bearing member when said suction means is operative.

8. A cleaning device according to claim 7, in which the flexible sheet like member has a low friction property at least at its portion which bears against the image bearing member.

9. A cleaning device for removing developer remaining on an image bearing member, which comprises an elastic cleaning blade disposed against the moving direction of the image bearing member and bearing against the surface of the image bearing member, a hood means having an opening facing the vicinity of a portion of the blade which bears against the image bearing member, the edge of the opening downstream of the image bearing member in said moving direction bearing against the blade, a suction means connected to the hood means, and a guiding means connected to an edge of the opening of the hood means upstream of the image bearing member in said moving direction and for guiding air flow toward the blade bearing portion.

10. A cleaning device according to claim 9, in which said air flow guiding means comprises a sheet like member.

11. A cleaning device according to claim 10, in which said sheet like member is constituted to keep an uniform clearance between it and the surface of the image bearing member.

12. A cleaning device according to claim 9, in which said sheet like member is of a flexible material.

13. A cleaning device according to claim 12, in which said sheet like member is disposed contactable with the surface of the image bearing member when said suction means is in a non-operable state.

14. A cleaning device according to claim 13, in which said sheet like member has a low friction property at least at its portion which contacts the image bearing member.

* * * * *